United States Patent [19]

Thuries et al.

[11] 4,205,209

[45] May 27, 1980

[54] ARTICULATED CONTACT FINGER

[75] Inventors: Edmond Thuries, Pusignan; Bernard Raynaud, Caluire; Armand Scarato, Lyons, all of France

[73] Assignee: Societe Anonyme Dite: Delle-Alsthom, Villeurbanne, France

[21] Appl. No.: 10,281

[22] Filed: Feb. 7, 1979

[51] Int. Cl.[2] ..... H01H 1/38; H01H 1/50; H01H 33/02

[52] U.S. Cl. ..... 200/163; 200/148 R; 200/260

[58] Field of Search ..... 200/148 R, 163, 255, 200/260

[56] References Cited

U.S. PATENT DOCUMENTS

| | | | |
|---|---|---|---|
| 1,776,138 | 9/1930 | Tritle | 200/260 |
| 2,143,650 | 1/1939 | Douglas | 200/260 |
| 2,261,008 | 10/1941 | Van Sickle et al. | 200/260 X |
| 2,315,618 | 4/1943 | Huffstutter | 200/163 X |
| 2,891,134 | 6/1959 | Ramrath | 200/260 X |
| 3,009,043 | 11/1961 | Goodwin, Jr. et al. | 200/260 X |
| 3,526,736 | 9/1970 | Ramrath | 200/260 X |

FOREIGN PATENT DOCUMENTS

| | | | |
|---|---|---|---|
| 1095915 | 12/1960 | Fed. Rep. of Germany | 200/163 |
| 1125999 | 3/1962 | Fed. Rep. of Germany | 200/260 |
| 111009 | 6/1944 | Sweden | 200/260 |
| 548103 | 9/1942 | United Kingdom | 200/148 R |

*Primary Examiner*—Stephen Marcus
*Attorney, Agent, or Firm*—Sughrue, Rothwell, Mion, Zinn and Macpeak

[57] ABSTRACT

An articulated contact finger of very high voltage gas-blast circuit-breaker. It is characterized in that the pin on which the finger is articulated is disposed between the contact piece and a spring which provides the force required at the contact point, a first support of the stationary articulation pin being situated between the articulation pin and the spring, said spring being disposed between said first support and a second support providing fixing means for the flexible connection connected to the contact point.

4 Claims, 1 Drawing Figure

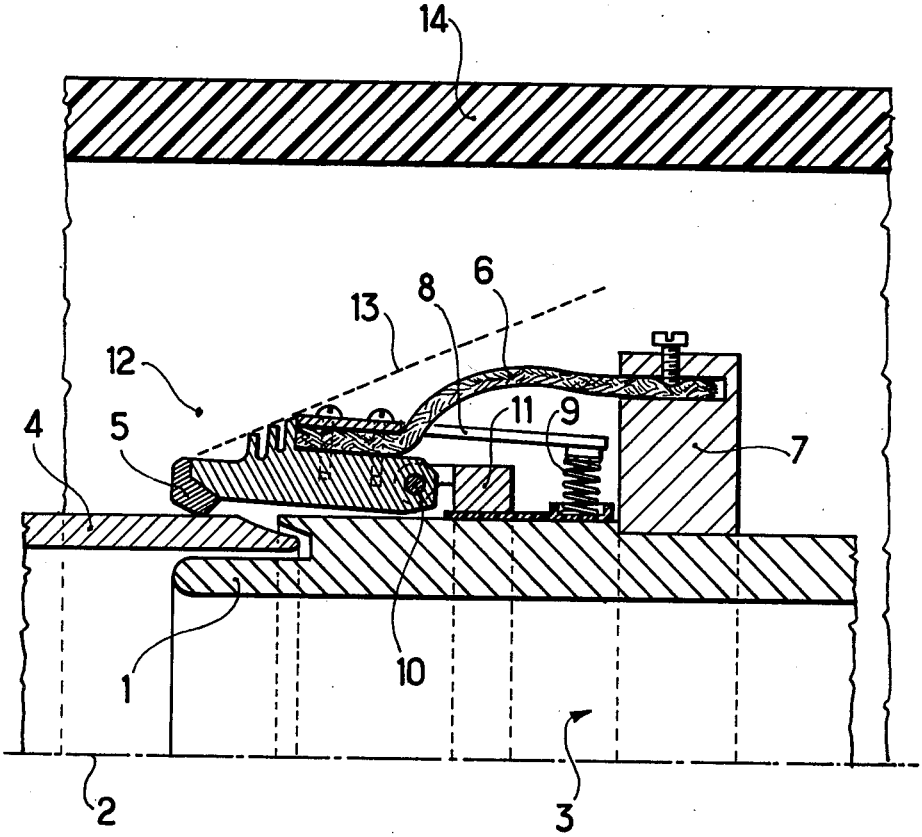
14
13
8
6
12
11
9
4
5
7
1
10
2
3

ARTICULATED CONTACT FINGER

FIELD OF THE INVENTION

The present invention relates to an articulated contact finger, in particular that of an arcing contact of a very high voltage gas-blast circuit-breaker.

DESCRIPTION OF THE PRIOR ART

In conventional devices, it is known to dispose the contact fingers in a ring around a blast nozzle to receive a moving tubular contact which is concentric around the blast nozzle. Since an electric arc is set up when the contacts open, it is known to quench the arc by a blast of compressed air. In prior dispositions, the contact fingers are each pressed against the tubular contact by a spring disposed at the level of the finger so that a ring-shaped support of the springs is disposed concentrically around the ring of contact fingers. This disposition hinders the flow of the blast gas since the spring support forms an obstacle thereto. Further, because of the concentric support, the dielectric field between the contact and the insulating tube which contains the circuit-breaking components requires an insulating tube which has a relatively large diameter. Lastly, the prior system is such that the contact extends over a relatively great axial length. This increases the delay in transmitting pressure drop necessary for quenching and consequently increases the response time of the circuit-breaker.

The object of the articulated contact finger in accordance with the invention is to remedy these drawbacks. In preferred embodiments of the invention quenching is improved due to the small diametral extent of the contacts in the vicinity of the end point of the arc; the reduction of the maximum diameter of the contacts helps to improve the dielectric separation between the contact and the insulating tube which contains the circuit-breaking components; the reduction of the contact length increases the speed of operation of the device.

SUMMARY OF THE INVENTION

The present invention provides an articulated contact finger which, in a circuit-breaker, establishes an electrical connection between a stationary contact and a moving contact, said finger including a contact piece and pivoting about a pin which is integral with a first support mechanically connected to the stationary contact. A spring provides a force to press the contact piece against the moving contact. A flexible connection is connected to a second support mechanically and electrically connected to the stationary contact. The pin is disposed between the contact piece and said spring, said spring is disposed between said stationary contact and a lever integral with said contact finger. According to one particularity of the invention, said first support is situated between said pin and said spring.

According to another particularity of the invention, said spring is disposed between said first support and said second support.

Although the contact fingers can be used on various types of circuit-breaker, the preferred example of the invention relates to a gas-blast circuit-breaker.

The present invention also relates to a ring of contact fingers surrounding the blast nozzle of a circuit-breaker wherein all of the contact fingers are situated inside a space taking the form of a low truncated cone whose small base corresponds to the outside diameter of the ends of said contact pieces and whose large base is equal to or greater than the diameter of the second support.

BRIEF DESCRIPTION OF THE DRAWING

The invention will be better understood on examining the example given hereinbelow with reference to the accompanying drawing in which the single FIGURE is a diagrammatic half cross-section through the axis of a circuit-breaking component of a gas-blast circuit-breaker in which the arcing contact constituted by a set of articulated contact fingers is shown in the closed position.

DETAILED DESCRIPTION

The FIGURE shows a cylindrical metal blast nozzle 1 having an axis 2, said nozzle firstly serving to convey the electric current and secondly being in communication, via a passage 3 with a blast valve, not shown, for evacuating compressed gas to extinguish the electric arc. One of the contacts of the circuit-breaker switch—tubular moving contact 4 made of metal—is mounted to move parallel to the axis 2. In the FIGURE, the contact 4 is shown in the closed position, positioned between the blast nozzle 1 and a plurality of contact pieces of articulated finger assemblies including fingers 5 which together constitute the other contact and have one end made of material such as sintered tungsten which withstands arcing. The articulated fingers 5 are disposed in a ring configuration along the generatrices of a cylinder of axis 2. The articulated fingers 5 are connected by flexible connections 6 to a metal support 7 which is an electrical conductor and which is fixed to the blast nozzle 1. An electric circuit is therefore constituted by the tubular contact 4, the contact piece of the articulated finger 5, the flexible connection 6, the support 7 and the blast nozzle 1.

In order to provide good electric conduction it is necessary to press the contact piece of the articulated finger 5 hard against the tubular moving contact 4. To do this, a rigid lever 8 transmits the force of a spring 9 to the contact piece of the articulated finger 5 which can rotate about a pin 10 held on either side of the finger 5 by a pin-fixing spider 11 which includes a ring that is rigidly mounted on the blast nozzle 1. Taking into account the positions and the dimensions of the pin 10 and of the lever 8, the reaction at the contact point of the contact piece 5 on the tubular moving contact 4 balances the force of the spring 9. The pin-fixing spider 11 and the springs 9 are electrically insulated from the blast nozzle 1 to prevent current from passing through the spring 9 and the pin 10.

The plane of the FIGURE intersects a truncated cone at 13. The small base of the cone corresponds to the outside diameter of the ends of the articulated finger 5 when in the position shown in the FIGURE, and the cone circumscribes the volume or space occupied by the fingers when in the closed position. The space 12 to the left of the cone 13 is thus free of switching components.

Reference 14 is a schematic illustration of the insulating wall of the chamber of the circuit-breaker inside which the contact is installed.

The passage 3 and the space 12 are filled with blast gas such as compressed air or sulphur hexafluoride.

When the switch is opened, a blast valve, not shown, is opened and causes a pressure drop in the passage 2; the tubular moving contact 4 moves to the left. After the fingers 5 have separated from the tubular contact 4, they are moved to abut against the blast nozzle 1 by the springs 9. The compressed blast gas which comes from the space 12 passes through the opening formed between the blast nozzle 1 and the tubular contact 4 and exits via the passage 3.

The advantages of the contact in accordance with the invention are as follows:

the reduction of the diameter occupied by the contact pieces (small base of the cone 13) and the formation of a greater space 12 around the articulated fingers 5 than in conventional devices, facilitate the flow of the gas and therefore the extinguishing of the arc. Since the head losses upstream from the blast nozzle 1 are very low, the blast is very great.

the maximum radial extent of the contact corresponding to the diameter of the support 7 for fixing the flexible connections is small. The fact that the diameter is small increases the distance which separates the metal parts of the contact from the wall 14 of the chamber of the circuit-breaker. This improves the dielectric performance of the circuit-breaking chamber.

The distance d between the end of the tube 4 and the end of the support 7 of the flexible connections is at a minimum. The pressure drop transmitted by the passage 2 constitutes a circuit-breaking command of the valve, said command is transmitted through the contact and reaches the contact more rapidly the shorter the length of the contact. Reducing the length d reduces the response time of the circuit-breaker and therefore increases its speed of operation.

We claim:

1. A longitudinally extending articulated contact finger assembly for a circuit-breaker, to establish an electrical connection between a longitudinally separable stationary contact and a moving contact, said finger assembly including a contact piece, means for pivoting said contact piece about a pin which is integral with a first support mechanically connected to the stationary contact, a spring for providing a force to press the contact piece against the moving contact, a flexible connection connected to a second support mechanically and electrically connected to the stationary contact, the improvement wherein said pin is disposed longitudinally between the contact piece and said spring, said spring is a compression spring and disposed between said stationary contact and a lever integral with said contact finger.

2. A contact finger according to claim 1, wherein said first support is situated longitudinally between said pin and said spring.

3. A contact finger according to claim 1, wherein said spring is longitudinally disposed between said first support and said second support.

4. A ring of contact fingers surrounding the blast nozzle of a circuit-breaker according to claim 1, wherein all of the contact fingers are situated inside a low truncated conical space whose small base corresponds to the outside diameter of the ends of said contact pieces and whose large base is equal to or greater than the diameter of the second support.

* * * * *